United States Patent [19]

Duncan

[11] Patent Number: 4,662,407

[45] Date of Patent: May 5, 1987

[54] METHOD AND APPARATUS OF CONTROLLING WARP TENSION ON A WEAVING LOOM

[75] Inventor: Jeffrey B. Duncan, Argyle, N.Y.

[73] Assignee: Albany International Corp., Menands, N.Y.

[21] Appl. No.: 828,714

[22] Filed: Feb. 12, 1986

[51] Int. Cl.[4] ..... D03D 49/06

[52] U.S. Cl. ..... 139/103; 66/210

[58] Field of Search ..... 139/97, 103, 110; 66/210, 211; 242/75.1, 75.2, 75.5

[56] References Cited

U.S. PATENT DOCUMENTS 2,539,295 1/1951 Clentimack ..... 139/103
2,539,296 1/1951 Clentimack ..... 139/103
4,129,154 12/1978 Bennelli ..... 66/211
4,572,244 2/1986 Kojima et al. ..... 139/103

*Primary Examiner*—Henry S. Jaudon
*Attorney, Agent, or Firm*—Kane, Dalsimer, Kane Sullivan & Kurucz

[57] ABSTRACT

An apparatus for maintaining the warp threads in a multi-beam loom at a constant tension includes tension sensors for each beam, and a microprocessor-based control circuit which provides individual speed control signals to the motors during each beam. The circuit samples the warp tension at regular intervals and recalculates the optimum speeds for each motor by taking into consideration the transverse effects on each beam caused by adjacent beams.

3 Claims, 2 Drawing Figures

METHOD AND APPARATUS OF CONTROLLING WARP TENSION ON A WEAVING LOOM

BACKGROUND OF THE INVENTION a. Field of Invention

This invention pertains to a method and apparatus for controlling the warp tension on a weaving loom having multiple beams for feeding the warp threads, and more particularly, for maintaining these warp threads under a constant tension.

b. Description of the Prior Art

Typically, in a weaving loom two devices are used to advance the warp threads and the fabric: a pair of rollers forming a nip engage the woven fabric to advance it by a predetermined amount corresponding to the speed at which the fabric is woven, and one or more beams driven by corresponding D.C. motors for paying off the warp threads. The tension of each warp thread is dependent on the speed of the beams relative to the rollers. If the beams turn faster than the rollers, the warp thread tension is reduced. If the beams turn too slow the warp thread tension will become higher than required.

The warp tension during weaving is very important for certain fabrics because it affects the inner structure of the fabric and certain fabric characteristics. For example, it has been found that for forming fabrics used in papermaking machines, the warp tension must be carefully maintained within a very narrow range during weaving for optimal water drainage, wearability, and minimal marking of the paper.

Initially, all looms employed a single beam for paying off warp threads. The beam was driven by a single motor in a classical analog control loop. However, for fabrics with 20,000 warp threads or more, looms with multiple beams became common, each beam being driven by a corresponding motor. Each motor was provided with an analog control loop, each loop operating in parallel, completely independently of the other loops. However, it was found that tension of warp threads from one beam is affected by the tension of the threads from another beam, and this interdependence tended to unbalance the parallel control loops so that warp tension could not be maintained within the preselected range without considerable tuning by highly trained personnel.

In addition, the tension in each warp thread in a loom varies dynamically during weaving depending on the actual weaving pattern used and this natural variation should be ignored. However, previous analog control loops tried to track these natural variations, causing further variations in the warp tension.

OBJECTIVES AND SUMMARY OF THE INVENTION

In view of the above, it is a principal objective of the present invention to provide a method and apparatus for controlling warp tension in a multiple-beam loom in which the interdependence between the beams is eliminated.

A further objective is to provide a method and apparatus which ignores natural dynamic variations in the warp tension due to the fabric pattern.

Other objectives and advantages shall become apparent from the following description of the invention.

In the present invention, a single microprocessor-based control circuit is used to drive all the beams of the loom. The control circuit calculates and provides optimal speed signals to the beam motor in accordance with a preselected formula. The formula has been designed to take into account the effects of beam interdependence. In addition, means are provided for compensating for the natural variations in the warp tensions due to shedding variations within a pattern repeat.

DETAILED DESCRIPTION OF THE INVENTION

Figure 1:
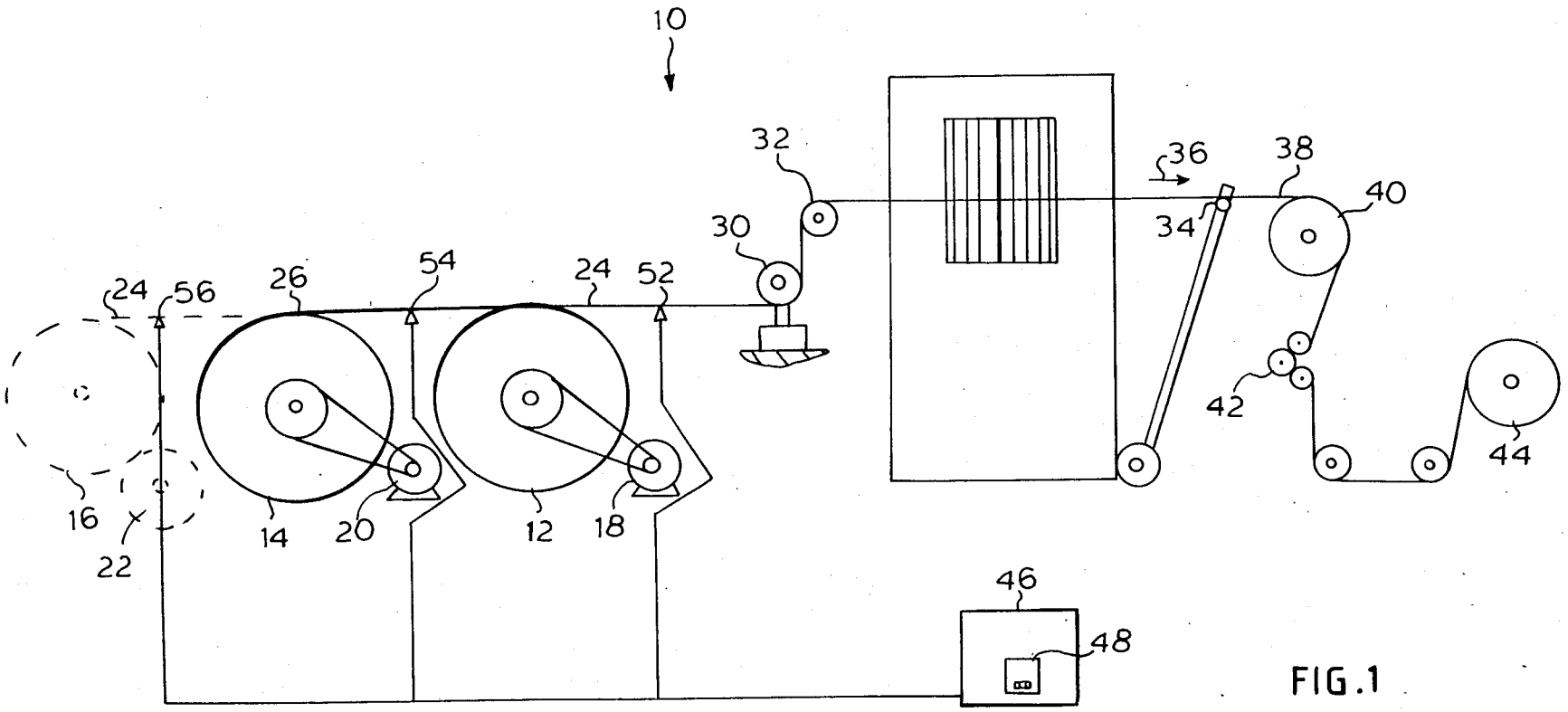
FIG. 1 shows a side view of a loom constructed in accordance with the invention.
Figure 2:
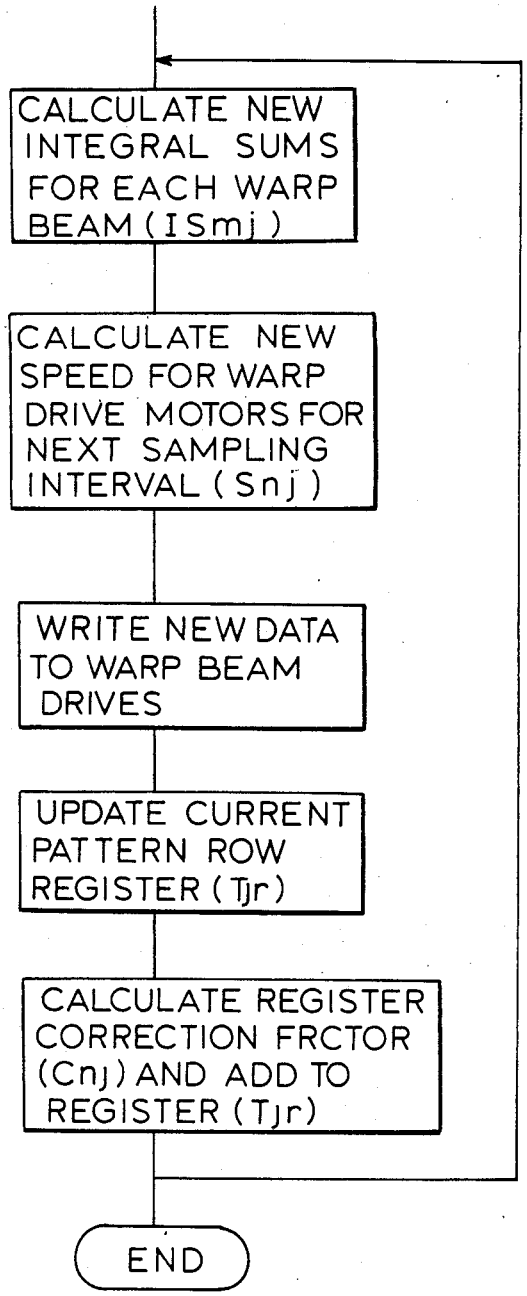
FIG. 2 shows a flow chart for the motor controller for the loom of FIG. 1.

Referring now to FIG. 1, a loom 10 comprises a plurality of horizontal beams 12, 14, 16, driven by motors 18, 20 and 22, respectively. The loom is also provided with rollers indicated by numerals 30, and 32, respectively. These rollers are provided to make an S-shaped turn in the warp threads as shown. Thus when warp threads come off rollers 32, they are substantially coplanar. The warp threads are advanced from the rollers toward a weaving zone demarked by a weaving edge or beat point indicated by numeral 34. As the warp threads move in the direction indicated by arrow 36, they are interwoven with weft threads in the usual manner. The weft threads have been omitted from the figures for the sake of simplicity. The woven fabric 38 is picked up by a breast roll 40 and rollers 42 which pull the fabric 38 away from the weaving region. The fabric is picked up by wind-up roller 44.

A loom control panel 46 includes a beam control circuit 48 and associated with the beam control circuit are a plurality of beam control registers which contain various operational parameters associated with the beam control as shall be described more fully below. Associated with each roller 12, 14, 16 there is a corresponding load cell 52, 54, 56 which measures the overall instantaneous tension of warp threads 24, 26 and 28 and therefore the overall tension on each beam 12, 14,16. The outputs of each of these load cells are coupled to beam control circuit 48.

It should be recognized that the loom described so far is very similar to a standard prior art loom except that in the prior art the loom control panel comprised two independent beam control circuits acting in parallel, one for each beam.

As previously mentioned, it is very important to keep the average tension on each beam 12, 14, 16 within a preselected range. To this end, the present inventor has devised a mathematical model for the beams in which an optimal speed is derived for each beam by decoupling the effects of tension errors in the other beams. Since the model is rather complex, requiring complex data manipulations, the beam control circuit 48 preferably comprises a digital microprocessor which at preselected intervals samples the tension readings obtained from load cells 52, 54, 56 and calculates the optimal speed Snj for each warp beam j at sample interval n as follows:

$$Snj = Soj + \frac{Kc}{T} Lnj + \frac{1}{Ki} Lnj + ISmj \quad (1)$$

where

Soj = initial or nominal speed for each beam;

T = sampling interval of the microprocessor (typically about 2 seconds);

Ki = the integration period for the warp beam (for a system which is "tuned", the system constant of intergration is about 500 seconds);

ISmj = Radius correction for beam j at m = n − 1 for converting the speed of motor as the warp threads are unwound from the beam.

Lnj is obtained from the following expression:

$$Lnj = \left( Tnj \frac{Kf + Kj}{KfKj} + \frac{1}{Kf} STnj \right) \quad (2)$$

where

Tnj = the instantaneous tension error for warp beam j, i.e. the difference between setpoint tension Toj and the instantaneous tension tnj as measured by the corresponding load cell.

Kf is the effective fabric modulus in kilograms/(meter × mil) and may determine for each fabric as follows. A new pattern is woven until the new fabric enters the nip; then the tension and fabric edge location are recorded, after which the tensions are reduced to zero. The change in fabric edge location is recorded (this is the strain, in mils) and the original fabric tension (the sum of the original warp tensions, in Kilograms per meter of width) is divided by the measured fabric strain, in mils to obtain Kf. Typically Kf falls in the range of 0.1 to 2.0.

Kj is the effective warp modulus (Kilograms per meter/mil). This value is calculated from Young's modulus equation, the bulk modulus of the warp fiber resin, and loom geometry. Kj typically falls in the range of 0.2 to 1.0.

The pattern tension profile registers (Tjr) are initialized to the tension setpoint whenever a new weave pattern is loaded; the pattern tension profile is integrated into the registers from that starting point as weaving progresses.

The term $ST_{nj}$ is derived as follows:

$$ST_{nj} = Tn1 + Tn2 + \ldots + TnW - T_{nj} \quad (3)$$

where w = the total number of beams. Kcj (the control loop gain) is also adjusted to compensate for the change in the radius of the beam as the warp threads are paid off as follows:

$$Kcj = Kcjo \frac{Soj + ISMj}{Soj} \quad (4)$$

where Kcjo is the initial or normal loop gain for the control loop for each motor j. A typical value for Kcjo is about 0.05.

It should be noted that equation (3) automatically compensates Kcj for the dynamic reduction in the radius of each beam during operation.

The microprocessor of control circuit 44 is programmed as shown in the flow chart of FIG. 3 to perform the above calculations.

For fabrics having relatively simple patterns, the shedding warp tension should be constant for each successive weft thread. However, for complicated patterns the shedding tension for beams changes with each weft thread of the pattern. Therefore, a plurality of beam registers 46 are provided for storing the beam tensions for each row of the pattern. The number of registers 46 depends on the number of beams and the number of weft threads per pattern repeat. For w beams and r weft threads per pattern repeat wr beam registers are required. Each register contains the "normal" row tension Tjr where j indicates the beam, r the course or row of the pattern. The microprocessor automatically selects the next Tojp for Toj after the completion of each row. The sampling period T must be equal to the period necessary to complete each row of the pattern.

The tensions Tjr are normally initialized at the beginning of a particular run or weave pattern and then dynamically adjusted after each pattern row is completed by using the formula:

$$Tjr = Tjr + \frac{1}{K_R} Tnj \quad (5)$$

for each beam j, where $K_R$ is the constant of integration for this process.

The average value of the register is then returned to the setpoint value by using the formula:

$$Tjr = Tjr - Cnj \quad (6)$$

where $$Cnj = [(Tj1 + Tj2 + \ldots + TjR)/R] - TOj,$$

where R = the number of rows in a pattern repeat.

After a time, Tojp stabilizes and it actually indicates a normal tension profile for the pattern repeat for each beam.

Equation (2) describes the interactions among the warp tensions of a multiple-beam loom, and is therefore a mathematical model of the loom/warp/fabric system. It is this model which, when introduced into the general PI (proportional-integral) control equation (1), eliminates the interdependence among warp beam tensions.

A microprocessor within beam control circuit 48 periodically samples the load on each beam as indicated by the corresponding load cells, and recalculates optimum speeds of each beam.

The microprocessor then generates individual motor control signals corresponding to these optimum speeds and sends them to the respective motors. For example, during each interval the microprocessor may also perfer various other functions related to the operation of the loom.

What is claimed is:

1. An apparatus for controlling the warp tension of a loom, said loom having several beams driven by variable speed motors for paying off warp threads, said apparatus comprising:

warp tension sensing means for sensing the tension of the threads from each beam and for generating instantaneous tension signals corresponding to said thread tensions;

control means for generating motor control signals for varying the speed of said motors to maintain the tension of the warp threads constant in accordance with said tension signals and in which the control means adjust to the speed of a motor j at T second intervals to drive the corresponding warp threads at a speed of Snj as follows:

$$Snj = Soj + KcjLnj/T + Lnj/Ki + ISnj$$

where n is the number of periods T since the loom was started, Soj is an initial speed, Kcj is a gain constant for a motor control loop formed by the tension sensor motor means and the control means; ISnj is a radius correction factor for beam j at m=n−1, and Lnj is the load factor on beam j as given by:

$$Lnj = \left( Tnj \frac{Kf + Kj}{KfKj} + \frac{1}{Kf} STnj \right)$$

where $Tnj = Toj - tnj$, Toj being an initial set tension for beam j and tnj being the instantaneous tension on beam after n intervals, as determined by the load scanning means, Kf being an effective fabric modulus;

Kj being an effective warp modulus; and STnj being derived by:

$$\text{Stnj} + \text{Tnj} + \text{Tu2} + \ldots \text{Tnw} - \text{Tnj}$$

where w is the total number of beams on the loom.

2. The apparatus of claim 1 wherein Kcj is given by $$Kcj + Kwo \frac{(Soj + Ismj)}{Soj},$$

Kcjo being an initial or normal loop gain.

3. An apparatus in accordance with claim 2, in which plurality of beam registers for storing the beam tensions for each row of the pattern is provided, said plurality of registers selected and arranged according to the number of beams and the number of weft threads per pattern repeat wherein for w beams and r weft threads per pattern repeat wr beam registers are required and wherein each register contains normal row tension Tjr where j indicates the beam and r the row of the pattern and wherein the microprocessor is selected and arranged to select the next Tojp for Toj after the completion of each row according to the formula:

$$Tjr = Tjr + \frac{1}{Kr} Tnj$$

for each beam j where Kr is the constant of integration, and wherein means are provided to return the average value of the register to the setpoint value according to the formula:

$$Tjr = Tjr - Cnj$$

where $$Cnj = ](Tj_1 + Tj_2 + \ldots Tjr)/R] - Toj$$

where R = the number of rows in a pattern repeat.

* * * * *